US008215249B2

(12) United States Patent
Fujihara

(10) Patent No.: US 8,215,249 B2
(45) Date of Patent: Jul. 10, 2012

(54) SEWING MACHINE

(75) Inventor: Shinya Fujihara, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 355 days.

(21) Appl. No.: 12/588,650

(22) Filed: Oct. 22, 2009

(65) Prior Publication Data

US 2010/0126397 A1 May 27, 2010

(30) Foreign Application Priority Data

Nov. 26, 2008 (JP) ..... 2008-300838

(51) Int. Cl.
*D05B 87/02* (2006.01)
*B65H 57/00* (2006.01)

(52) U.S. Cl. ..... 112/225; 112/302

(58) Field of Classification Search ..... 83/910, 83/936; 112/225, 302, 285
See application file for complete search history.

(56) References Cited

U.S. PATENT DOCUMENTS

| | | | | |
|---|---|---|---|---|
| 2,261,680 | A * | 11/1941 | Hale | 112/298 |
| 4,606,289 | A * | 8/1986 | Hara et al. | 112/295 |
| 5,069,150 | A * | 12/1991 | Ogawa | 112/241 |
| 5,596,940 | A | 1/1997 | Yamada et al. | |
| 5,722,335 | A * | 3/1998 | Kamewada et al. | 112/285 |
| 2005/0211145 | A1* | 9/2005 | Sakuma et al. | 112/302 |
| 2006/0011119 | A1* | 1/2006 | Tseng | 112/302 |

FOREIGN PATENT DOCUMENTS

| | | |
|---|---|---|
| JP | A-3-133484 | 6/1991 |
| JP | U-3-65578 | 6/1991 |
| JP | Y2-5-17032 | 5/1993 |
| JP | A-8-173676 | 7/1996 |
| JP | A-9-99192 | 4/1997 |
| JP | A-10-179969 | 7/1998 |
| JP | A-11-151393 | 6/1999 |
| JP | A-2004-135922 | 5/2004 |
| JP | A-2004-135923 | 5/2004 |

* cited by examiner

*Primary Examiner* — Ismael Izaguirre
(74) *Attorney, Agent, or Firm* — Oliff & Berridge, PLC

(57) ABSTRACT

A sewing machine having a threading path defined at a sewing machine head and being engaged with a needle thread to guide the needle thread in threading a sewing needle; a thread holder provided on the threading path and that includes a thread holding plate receiving the needle thread being introduced from outer to inner peripheral side of the thread holder to clamp the needle thread; a thread cutter provided on a faceplate covering the head and that cuts off a needle thread tip sequentially engaged with the threading path; a threader unit that passes the needle thread through a needle eye; and a passage resistance applier provided downstream relative to the thread holder and upstream relative to the thread cutter and that applies a predetermined amount of resistance on the needle thread passing therethrough to introduce the needle thread to the inner peripheral side of the needle holding plate.

8 Claims, 10 Drawing Sheets

SEWING MACHINE

CROSS-REFERENCE TO RELATED APPLICATIONS

This application is based upon and claims the benefit of priority from the prior Japanese Patent Application 2008-300838, filed on, Nov. 26, 2008 the entire contents of which are incorporated herein by reference.

FIELD

The present disclosure relates to a sewing machine provided with a threader unit at its sewing machine head for threading an eye of a sewing needle attached to a needle bar with a needle thread drawn from a needle thread supply.

BACKGROUND

Threader unit provided in conventional sewing machines are disposed in the left side proximity of a needle bar and is provided with a threader shaft configured vertically movably and rotatably. At the lower end of the threader shaft, a threader hook, a thread guide for engagement of a needle thread, and a thread holder disposed leftward relative to the thread guide are provided. Further, provided at the threader unit are components such as a rotary mechanism that rotates the threader hook in the horizontal direction, and a vertically moving mechanism that vertically moves the threader shaft in response to the user operation of the control lever.

Thread holder is provided with a plate support, a presser plate disposed on the underside of the plate support, and a coil spring that bias the presser plate upward toward the plate support. Needle thread is held by being clamped between the plate support and the presser plate. At the left side of the faceplate of the sewing machine head, a thread cut element is provided. The thread cut element has a groove for passing the needle thread through it and a cutter for cutting the needle thread situated deep inside the groove. Using the thread cutter, the user is allowed to cut the tip of the needle thread engaged in a threading path to a length suitable for starting the sewing operation to be executed after completing the threading operation.

As a preparatory task in executing the threading operation with the threader unit, the user is to engage the needle thread with a predetermined threading path. To elaborate, the needle thread is drawn from a thread spool serving as a needle thread supply and is initially engaged with a thread tensioner and a thread take-up. Then, the needle thread is engaged with the thread guide portion of the needle bar, a thread guide, and then retained by a thread holder. Finally, the tip of the needle thread is cut by the needle cutting element. In order to hold the needle thread with the thread holder, the user is to take the lengthwise intermediate portion of the needle thread and insert it between the plate support and the presser plate.

In threading the needle thread with the threader to the components of the sewing machine under the above described state, the user is to press down the control lever provided on the side surface of the sewing machine head. Responsively, components such as the threader shaft are lowered relative to the needle bar to a predetermined position. Then, the threader hook is rotated by the rotary mechanism to be passed through the eye of the sewing needle, whereafter the tensed needle thread is seized by the thread guide. Then, when the user cancels the lowering of the control lever, the thread hook rotates in the reverse direction to be moved out of the needle eye. Thus, the needle thread seized by the thread hook is passed through the needle eye. Thereafter, the threader shaft, etc., are lifted to their original preparatory positions.

For reliable seizure of needle thread by the thread guide, the needle thread needs to be retained in a tense state by the threader hook without slacking. This requires the user to insert the needle thread far enough into the space between the plate support and the presser plate to reach the radial inner peripheral side for tight clamping between the plate support and the presser plate by the thread holder.

To meet the above requirement, suggestions have been made to create a space between the plate support and the presser plate by placing the lower portion of a sewing machine cover in engagement with the presser plate and opening the presser plate relative to the plate support against the spring force of a coil spring when assuming the preparatory position during the threading operation carried out by the user. Such configuration facilitates the task of inserting the needle thread between the plate support and the presser plate. Further, under such configuration, when executing the threading operation, in other words, when the thread holder is lowered, the engagement between the lower portion of the sewing machine cover and presser plate is cancelled. Thus, the spring force of the coil spring urges the presser plate to be pressed against the plate support to clamp the needle thread.

The space created between the plate support and the presser plate does indeed facilitate needle thread insertion but at the same time, it increases the susceptibility of thread disengagement. Thus, in the threading operation by the user employing the above suggested configuration, the needle thread engaged with the thread holder may be loosened against user intention when the needle thread is cut by the thread cut element after passing the needle thread between the plate support and the presser plate. The slack may ultimately result in disengagement of the needle thread from the thread holder to result in a failure of the threading operation. Further, since the presser plate is configured to be opened relative to the support plate through engagement with the lower portion of the sewing machine cover, the suggested configuration introduces complexity in the structure and in the shapes of the components.

SUMMARY

One object of the present disclosure is to provide a sewing machine including a threader unit that allows a needle thread to be reliably held by a needle holder during a preparatory operation carried out by a user in which a needle thread is engaged with a threading path in relatively simple configuration.

In one aspect the sewing machine of the present disclosure includes a sewing machine head, a needle thread supply, a needle bar, and a sewing needle attached to a lower end of the needle bar, the sewing machine including a threading path that is defined at the sewing machine head and that is sequentially engaged with needle thread drawn from the needle thread supply to guide the needle thread in threading the sewing needle; a thread holder that is provided on the threading path and that includes a thread holding plate which receives an intermediate portion of the needle thread being introduced from an outer peripheral side to an inner peripheral side of the thread holder to clamp the needle thread; a thread cutter that is provided on a faceplate that covers an outer surface of the sewing machine head and that cuts off a tip of the needle thread sequentially engaged with the threading path to obtain an appropriate thread length for threading the sewing needle; a threader unit that passes the needle thread engaged with the needle threading path and having the tip cut off by the thread cutter through an eye of the sewing needle; and a passage resistance applier that is provided downstream relative to the thread holder provided on the threading path and upstream relative to the thread cutter and that applies a predetermined amount of resistance on the needle thread passing through the passage resistance applier to allow the needle thread to be introduced to the inner peripheral side of the needle holding plate of the needle holder.

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION

A description will be given hereinafter on a first exemplary embodiment of the present disclosure with reference to FIGS. 1 to 7. For the ease of explanation, the direction in which the user operating the sewing machine positions himself relative to the sewing machine is defined as the front; the direction in which the cloth is fed as the Y-direction indicated in FIGS. 6A, 6B, and 7; and the direction in which a needle bar, in other words, a sewing needle is swung in the left and right direction during zigzag sewing as the X-direction indicated in FIGS. 1 and 2.

Figure 1:
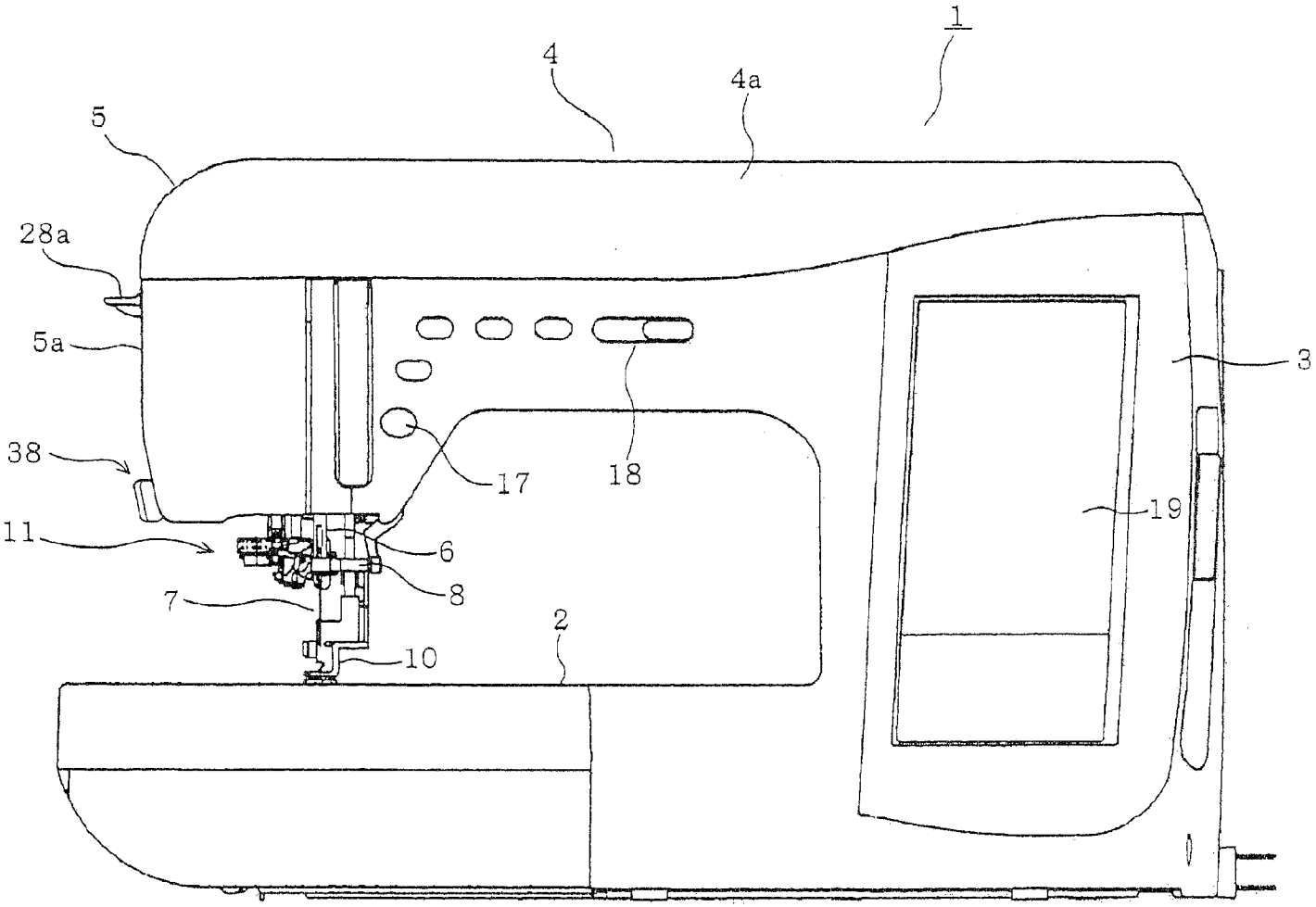
FIG. 1 is a front view of a sewing machine according to a first exemplary embodiment.

Referring to FIG. 1, main body 1 of the sewing machine is integrally provided with sewing machine bed 2 extending in the left and right direction (X-direction), pillar 3 extending upward from the right end of sewing machine bed 2, and arm 4 extending leftward as viewed in FIG. 1 from the upper end of pillar 3. The extreme end of arm 4 constitutes sewing machine head 5. Sewing machine head 5 is provided with a plastic faceplate 5*a* covering the left front and the left side surface of sewing machine head 5 as viewed in front view.

The upper portion of arm 4 is covered openably/closably by cover 4*a*. As known, a thread spool accommodation not shown allowing detachable attachment of a needle thread spool serving as a needle thread supply is provided beneath cover 4*a*. Replacement and other similar activities are carried out by opening cover 4*a*.

Figure 2:
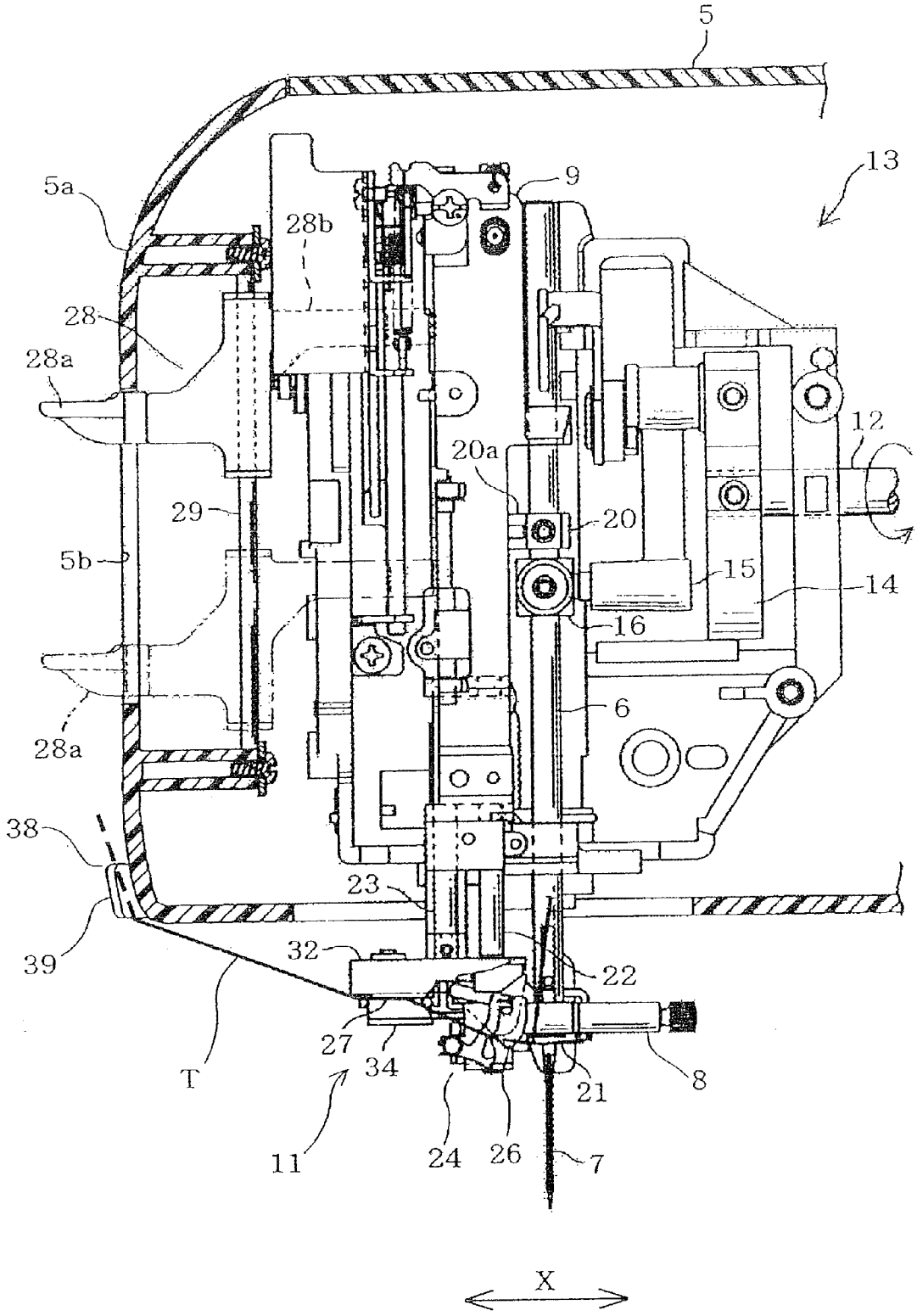
FIG. 2 is a vertical cross sectional front view depicting an interior configuration of a sewing machine head.
Figure 3A:
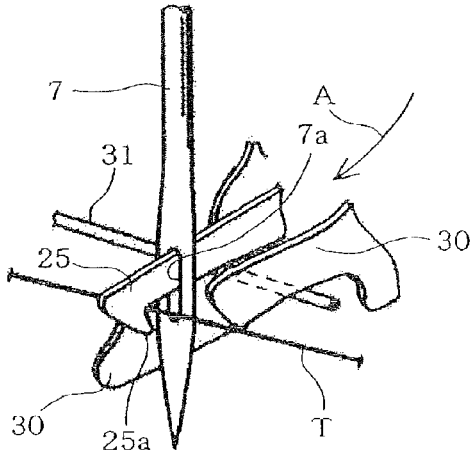
FIG. 3A is an enlarged perspective view of a threader hook passed through an eye of a sewing needle during a threading operation.
Figure 3B:
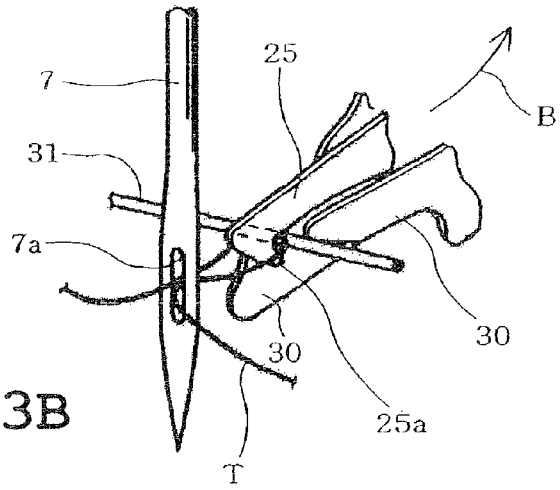
FIG. 3B is an enlarged perspective view of a threader hook after its returning movement during the threading operation.
Figure 5:
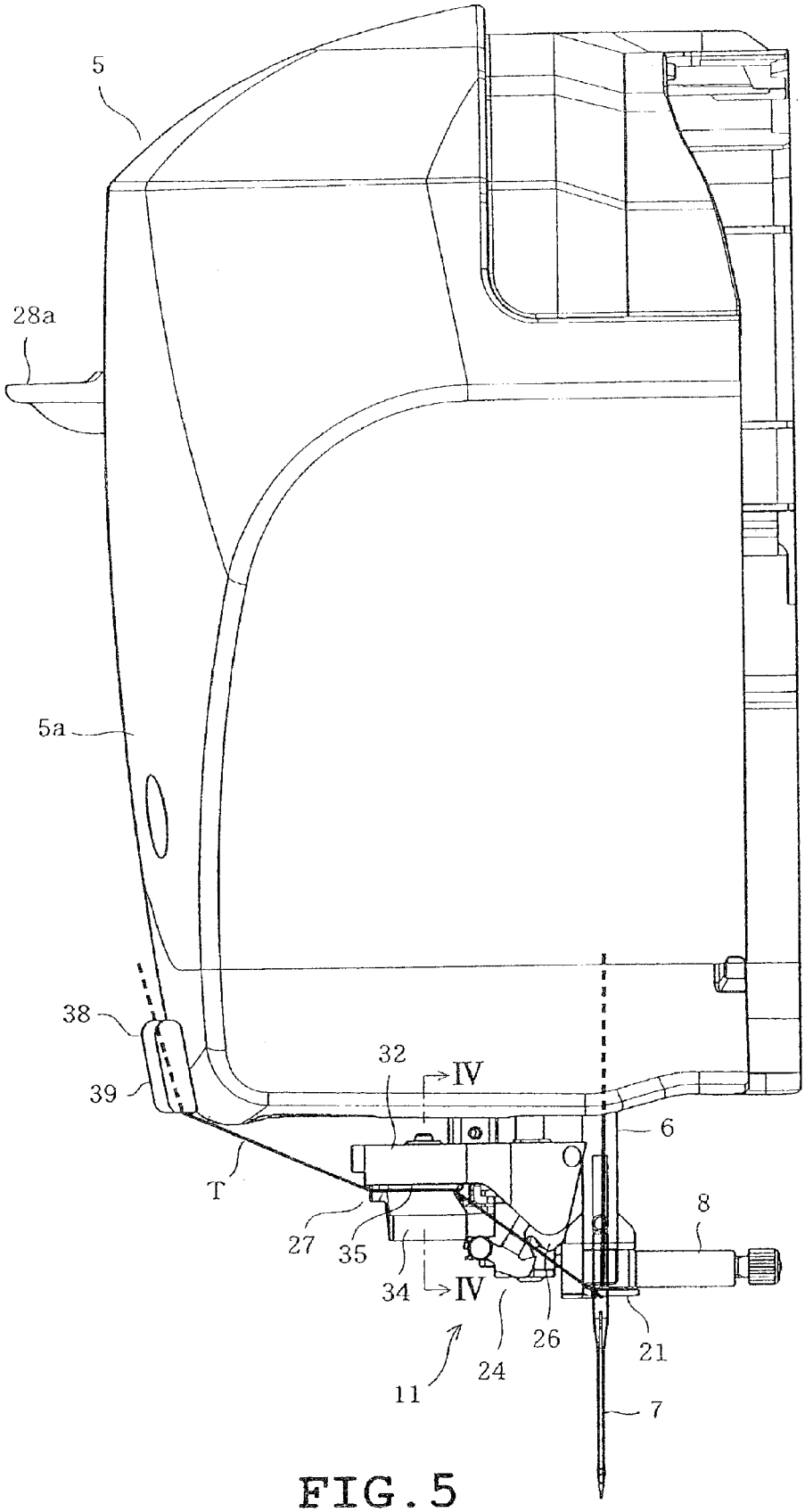
FIG. 5 is a partial front view of a threader mechanism.

As also shown in FIGS. 2 and 5, sewing machine head 5 is provided with needle bar 6. At the lower end of needle bar 6, sewing needle 7 is attached via needle clamp 8. As can be seen in FIG. 2, needle bar 6 is supported vertically movably by needle bar support 9. Needle bar support 9 is mounted swingably in the left and right direction (X-direction) by the sewing machine frame. Referring back to FIG. 1, sewing machine head 5 is further provided with presser foot 10 that extends further below needle bar 6 or sewing needle 7. In the left side of needle bar 6 or sewing needle 7, threader unit 11 according to the present exemplary embodiment is provided. As shown in FIGS. 3A and 3B, threader unit 11 passes needle thread T drawn from the needle thread spool through eye 7*a* of sewing needle 7 and will be later described in detail.

As partially shown in FIG. 2, arm 4 contains sewing machine main shaft 12 that is driven in rotation by a sewing machine motor not shown. Within sewing machine head 5, needle bar drive mechanism 13 is provided for vertically moving needle bar 6 through the drive force of sewing machine main shaft 12. Needle bar drive mechanism 13 includes needle bar crank 14 coupled to the tip of sewing machine main shaft 12, crank rod 15 rotatably coupled to the tip of needle bar crank 14, and needle bar clamp 16 that connects crank rod 15 and needle bar 6.

Though not shown nor described in detail, a needle bar swing mechanism is provided within sewing machine head 5. The needle bar swing mechanism is driven by a pulse motor to swing needle bar support 9 and consequently needle bar 6 in the direction (X-direction) orthogonal to the cloth feed direction (front and rear or Y-direction). Further provided within sewing machine head 5, are components such as a thread take-up drive mechanism for vertically driving a thread take-up in coordination with the vertical movement of needle bar 6, and a thread tensioner for adjusting the tension of needle thread T.

Referring back to FIG. 1, on the front face of arm 4, various operational keys or switches are provided including start/stop switch 17 for instructing the starting and stopping the sewing operation and speed adjustment dial 18. On the front face of pillar 3, a sizable and vertically elongate liquid crystal display 19, referred to as LCD 19 for simplicity hereinafter, is provided which is capable of displaying full color. LCD 19 is provided with a touch panel on its surface.

Though not shown in detail, LCD 19 displays items such as a menu screen for selecting various utility stitches such as straight stitches and zigzag stitches, an embroidery pattern selection screen for selecting various embroidery patterns, a function selection screen for selecting and executing various functions, and various messages. Various input operation keys are assigned on the touch panel.

On the upper surface of sewing machine bed 2, a needle plate not shown is provided. Though not shown, within sewing machine bed 2 below the needle plate are components such as a feed dog drive mechanism that drives the feed dog in synchronism with the vertical movement of needle bar 6, a full rotary shuttle that contains a bobbin thread bobbin and that forms stitches in cooperation with sewing needle 7, and a thread cut mechanism.

Next, a description will be given on threader unit 11 and its peripheral components. As can be seen in FIG. 2, needle bar 6 is inserted through needle support 9 so as to be supported vertically movably by it and is driven vertically at a predetermined stroke by needle bar drive mechanism 13. When the sewing operation is stopped, in other words, when the sewing machine motor is stopped, needle bar 6 is stopped at a predetermined raised position (upper needle position) shown in FIG. 2. Immediately above the connection between needle bar 6 and needle bar clamp 16, positioning element 20 is mounted which is provided with a protrusion 20*a* protruding leftward. At the lower end of needle bar 6, needle bar thread guide 21 is provided.

Threader unit 11 is assembled into needle bar support 9 so as to be located at the left side of needle bar 6. As shown in FIGS. 2 and 5, threader unit 11 includes a couple of first and second threader shafts 22 and 23, threader mechanism 24 provided at the lower ends of the first and the second threader shafts 22 and 23, and a rotary mechanism not shown that rotates the first threader shaft 22. Threader mechanism 24 comprises a threader hook 25 shown in FIGS. 3A and 3B and thread guide portion 26 provided at the lower end of first threader shaft 22, and thread holder 27 provided at the lower end of second threader shaft 23.

As shown in FIG. 2, first threader shaft 22 extends vertically at the immediate left side of needle bar 6 and is supported vertically movably and rotatably, that is, coaxially rotatably by needle bar support 9. The second threader shaft 23 is located at the immediate left side of the first threader shaft 22 and is vertically movably supported by needle bar support 9. Consistent upward bias relative to needle bar support 9, that is, toward the uppermost preparatory position is exerted on the second threader shaft 23 by a first compression coil spring not shown. The first and the second threader shafts 22 and 23 are vertically moved integrally with their upper ends in alignment. Faceplate 5*a*, being slightly spaced away to the left side of the second threader shaft 23, extends vertically and has guide shaft 29 secured on it for guiding threader lever 28.

Though not shown, at the upper ends of the first threader shaft 22 and second threader shaft 23, a threader slider is inserted vertically movably so as to extend across them. The threader slider is provided with a semicircular wall, in other words, half cylinder wall that covers the left half of the upper portion of the first threader shaft 22. The semicircular wall has a cam groove running obliquely on it. As opposed to this, on the upper portion of the first threader shaft 22, a horizontal slide pin is passed through it. The slide pin is inserted into the cam groove to constitute the rotary mechanism. The first threader shaft 22 is provided with a second compression coil spring situated between a spring receiving pin provided below the slide pin and the lower end of the threader slider.

Figure 6A:
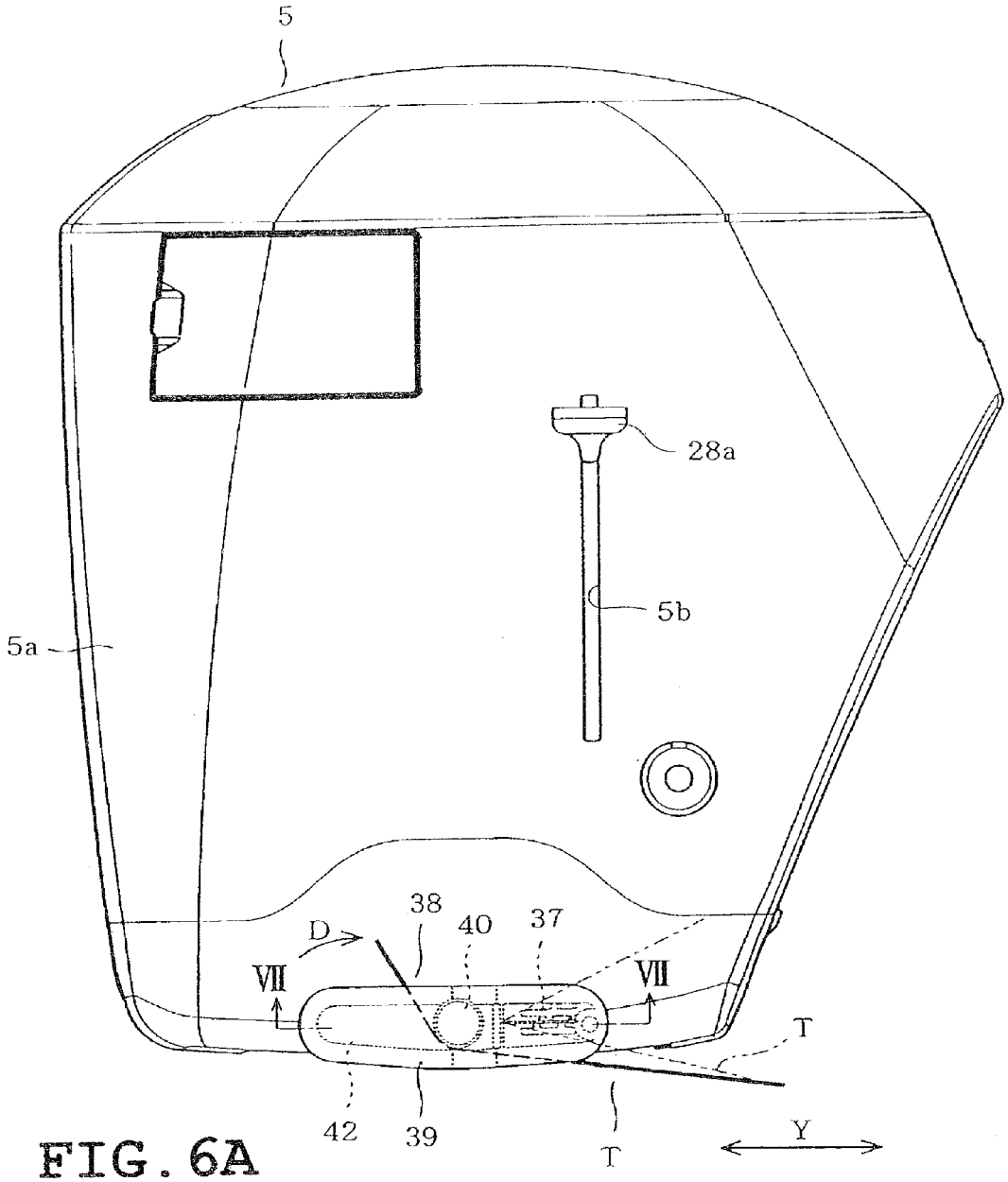
FIG. 6A is a left side view of the sewing machine head.

Guide shaft 29 has a threader lever 28 vertically movably engaged with it for vertically moving the first and the second threader shafts 22 and 23. Threader lever 28 extends leftward as viewed in FIG. 2 and is provided with operation handle 28*a* as well as a lever plate 28*b* extending rightward as viewed in FIG. 2. As can be seen in FIG. 6A, operation handle 28*a* extends through a vertically elongate slit 5*b* defined on faceplate 5*a* to allow user operation at the side surface of sewing machine head 5. Lever plate 28*b* being engaged with the slider lever is adapted to vertically move the threader slider.

Thus, when downward pressure is not exerted on threader lever 28, threader lever 28 is situated at the upper end of guide shaft 29 as shown in FIGS. 2 and 5. Under such state, threader slider as well as the first and the second threader sliders 22 and 23 are urged to the uppermost position relative to needle support 9 by the first compression coil spring. This position is defined as the preparatory position in which a later described preparatory operation to prepare for user operated threading of needle thread T is carried out. In the preparatory position, threader mechanism 24, that is, components such as threader hook 25 and thread guide portion 26 provided at the lower ends of the first and second threader shafts 22 and 23 are positioned at the lower end proximity of needle bar 6.

When threader lever 28 and consequently the first and second threader shafts 22 and 23, and threader mechanism 24 are lowered against the spring force of the first compression coil spring from the preparatory position, threader lever 28 along with the foregoing components are lowered by a predetermined distance. Under such state, the slide pin provided at the first threader shaft 22 is placed in engagement with protrusion 20*a* of positioning element 20 provided at needle bar 6 to limit further descent of the first threader shaft 22. The above described position is defined as a threading position. At the threading position, the height of threader hook 25 and the height of eye 7*a* of sewing needle 7 are at level to allow execution of a threading operation.

During the threading operation, threader lever 28 is further lowered from the aforementioned position being lowered by the predetermined distance. The further descent of threader lever 28 causes threader slider to further descend relative to the first and second threader shafts 22 and 23 against the spring force of the first and the second compression coil springs. The slide pin of the first threader shaft 22, thus, relatively moves obliquely upward within the threader slider cam groove. Thus, rotary mechanism rotates the first threader shaft 22 and consequently components such as threader hook 25 in a clockwise direction in top view to execute the threading operation.

Then, when downward pressure is released from threader lever 28, the spring force of the first and the second compression coil springs causes threading lever 28 and consequently the threader slider to be elevated relative to the first and second threader shafts 22 and 23. At this instance, the slide pin of the first threader shaft 22 relatively descends within cam groove of the threader slider to cause the first threader shaft 22 and consequently components such as threader hook 25 to be rotated in the reverse direction. Then, threader lever 28 is elevated by the predetermined distance to raise the first and second threader shafts 22 and 23 and threader mechanism 24 to the preparatory position.

Though not described in detail, threader hook 25 provided at threader mechanism 24 has a downwardly oriented hook at its tip, as shown in FIGS. 3A and 3B, and is capable of passing through eye 7*a* of sewing needle 7. At the lower end of the first threader shaft 22, a couple of guide elements 30 situated at both sides of threader hook 25 and wire 31 are provided. Thread guide portion 26 provided at the lower end of the first threader shaft 22 holds needle thread T in the horizontal state in front of eye 7*a* of sewing needle 7 as shown in FIG. 3A during the threading operation, in other words, when the first threader shaft 22 is being rotated.

Figure 4:
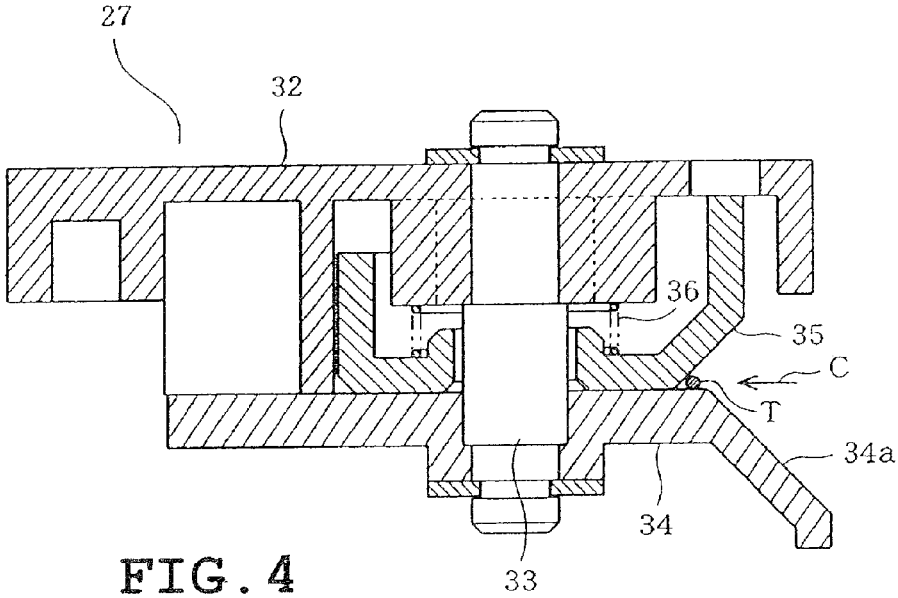
FIG. 4 is a vertical cross sectional left side view of a thread holder taken along line IV-IV of FIG. 5.

Thread holder 27 provided at lower end of the second threader shaft 23 holds the tip of needle thread T and is configured as shown in FIG. 4. As can be seen in FIG. 4, link guide 32 is provided at the lower end of the second threader shaft 23, which link guide 32 has an upper end of a downwardly extending pin 33 mounted on it. At the lower end of pin 33, guide plate 34 is provided. Further, at the intermediate portion of pin 33, thread holding plate 35 for clamping needle thread T with guide plate 34 is fitted vertically movably. Thread holding plate 35 is biased downward in the direction to contact guide plate 34 by coil spring 36 provided between thread holding plate 35 and the underside of link guide 32. Thread holding plate 35 is curved in the form of a dish such that its outer peripheral side rises upward. At the front end of guide plate 34, a downwardly sloping taper surface 34*a* is formed.

Figure 7:
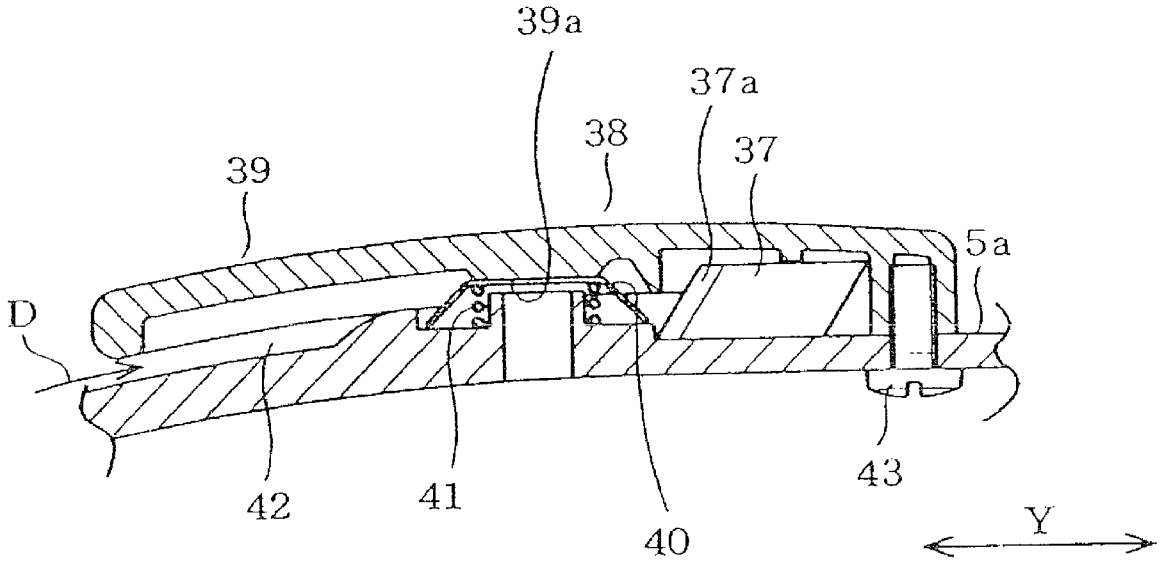
FIG. 7 is a transverse sectional view of the bottom of the passage resistance applier taken along line VII-VII of FIG. 6A.

The intermediate portion of needle thread T is thus, guided along taper surface 34*a* to be inserted far deep into the space between guide plate 34 of thread holder 27 and thread holding plate 35 in the direction indicated by arrow C of FIG. 4 which is oriented from the outer peripheral side to the inner peripheral side of thread holding plate 35. Thus, needle thread T is clamped between guide plate 34 and thread holding plate 35 to establish the hold by thread holder 27. As shown in FIGS. 6A and 7, on the left side surface of faceplate 5*a* of sewing machine head 5, thread cutting element 37 is provided for cutting the tip of needle thread T, engaged with the later described threading path, to an appropriate length. Thread cutting element 37 will be later described in detail.

The user performs the preparatory steps for the threading operation as follows. Needle thread T is drawn from the needle thread spool when threader mechanism 24 is situated in the preparatory position to engage needle thread T with a predetermined needle threading path constituted by components such as thread tensioner and thread take-up. Then, needle thread T is engaged with needle bar thread guide 21 of needle bar 6 to be thereafter held through engagement with thread guide portion 26 of threader mechanism 24. Then, needle thread T is passed between guide plate 34 of thread holder 27 and thread holding plate 35. Then, needle thread T is passed through thread cutting element 37 to cut off the tip of needle thread T. Thus, needle thread T is held at thread holder 27 after being sequentially engaged with the applicable components residing on threading path. As a result, needle thread T is cut to the suitable length to complete the preparation for the threading operation.

From this state, threader mechanism 24 is lowered to the threading position in response to the user's depression of threader lever 28, whereby the first threader shaft 28 is rotated. Thus, as shown in FIG. 3A, threader hook 25 is moved in the direction of arrow A to be passed through eye 7*a* of sewing needle 7. Then, threader hook 25 seizes needle thread T held in a tense horizontal state by thread guide portion 26 with its hook 25*a*.

Thereafter, when the user releases the depression of threader lever 28, the first threader shaft 22 is rotated in the reverse direction. Thus, threader hook 25 takes a returning movement in the direction of arrow B shown in FIG. 3B to cause needle thread T to be passed through eye 7*a* to complete needle threading. The configuration and operation of threader unit 11 and threader mechanism 24, in particular, is detailed in U.S. Pat. No. 7,281,479 which is a prior patent application owned by the applicant.

Next, a description will be given on passage resistance applier 38 that applies a predetermined resistance on needle thread T when needle thread T is passed through it to cause needle thread T to be introduced to the inner peripheral side of thread holding plate 35 of thread holder 27. Passage resistance applier 38 is situated downstream of threading path relative to thread holder 27 and upstream relative to thread cut element 37. More specifically, as can be seen in FIGS. 5 to 7, passage resistance applier 38 is situated in the rearward proximity of thread cut element 37 located at the lower side portion of faceplate 5*a*. The above described position of passage resistance applier 38 is situated toward the far left side and slightly upward from thread holder 27 in the preparatory position. Passage resistance applier 38 is unitized with thread cut element 37.

Figure 6B:
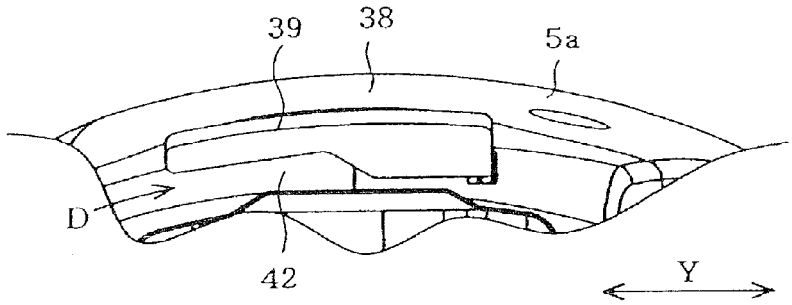
FIG. 6B is a bottom view of a passage resistance applier.

Passage resistance applier 38 is configured by attaching a plastic cover 39 on the outer surface of faceplate 5*a* and providing tension plate 40 and coil spring 41 on the inner surface side of cover 39. As shown in FIGS. 6A, 6B, and 7, cover 39 takes an ellipse form elongated in the front and rear direction (Y-direction). The front end side of cover 39 is mounted on faceplate 5*a* by screw 43. Between the inner surface of cover 39 and the outer surface of faceplate 5*a* except the front end portion of cover 39, a space is created for allowing needle thread T to pass through. Thus, the space defines threading groove 42 that opens up toward the rear side of cover 39 and that runs in the vertical direction.

As shown in FIG. 7, between cover 39 and faceplate 5*a*, thread cut element 37 is provided in the space that communicates with threading groove 42. Thread cut element 37 is oriented substantially horizontally and is provided with blade 37*a* having its cutting edge oriented rearward. In the above described preparatory operation prior to threading operation, the user, after passing needle thread T through thread holder 27, takes needle thread T by its tip and brings needle thread T to the rearward upper portion of cover 39 of passage resistance applier 38 as can be seen in FIG. 6A. Then, the tip of needle thread T is moved forward, that is, in the direction of arrow D so as to introduce needle thread T into threading groove 42. As a result, needle thread T moves forward while passing through threading groove 42 to be cut by thread cut element 37. User safety can be secured in cutting needle thread T since blade 37*a* of thread cut element 37 is covered by cover 39.

Then, as shown in FIG. 7, at the longitudinal (Y-directional) mid portion of cover 39, a round protrusion is formed that slightly protrudes toward faceplate 5*a*. Tension plate 40 includes a planar round surface that is capable of contacting protrusion 39*a* and a tapered surface in continuation with the outer periphery of the round surface. Tension plate 40 is held by faceplate 5*a* so as to be movable in the vertical direction as viewed in FIG. 7 such that tension plate 40 may be placed in contact or separated away from protrusion 39*a*. Between faceplate 5*a* and tension plate 40, coil spring 41 is provided to exert consistent bias to press tension plate 40 against protrusion 39*a*.

When the tip of needle thread T is cut by the user in the above described maneuver, needle thread T is inevitably passed between protrusion 39*a* and tension plate 40 when needle thread T is moved forward to be introduced into threading groove 42. At this instance, a predetermined amount of resistance or tension is applied on needle thread T. The resistance applied on needle thread T urges needle thread T in the direction indicated by arrow C to be engaged between guide plate 34 of thread holder 27 and thread holding plate 35.

Next, a description will be given on the operation of the above described configuration. Prior to passing needle thread T through eye 7*a* of sewing needle 7 using threader unit 11, the user is required to go through the preparatory steps. First, the user is to take needle thread T drawn from the thread spool serving by its tip and sequentially engage needle thread T with the components of the threading path while further drawing required amount of needle thread T. At the end, needle thread T is introduced into threading groove 42 of passage resistance applier 38 and the extra length of the free end of the needle thread t is cut off by needle cut element 37.

Thus, needle thread T drawn from the needle thread spool is engaged with components such as thread tensioner and thread take-up provided along the predetermined path and then engaged with needle bar thread guide 21 of needle bar 6, thread guide portion 26 of threader mechanism 24, and passed between guide plate 34 and thread holding plate 35 to establish the hold by thread holder 27. At this instance, needle thread T is cut to the appropriate length to complete the preparatory steps.

Now that threading operation is ready to be executed, the user now proceeds to press down control tip 28*a* of threader lever 28 to lower threader mechanism 24 to the threading operation position. Further, as can be seen in FIGS. 3A and 3B, threader hook 25 is rotated back and forth in the directions indicated by arrows A and B by the rotary mechanism to execute the threading operation. Thereafter, when the user release the depression of threader lever 28, threader mechanism 24 is elevated and returns to the original preparatory position. Sewing machine is now ready to execute the sewing operation.

In the above described preparatory steps, failure in obtaining secure engagement of needle thread T with thread holder 27, meaning that needle thread T is not introduced far enough between thread holding plate 35 and guide plate 34, needle thread T is readily disengaged from thread holder 27. The disengagement will deprive of tension from needle thread T being engaged with thread guide portion 26 during the threading operation, causing needle thread T to slack and fail the threading operation, which means that needle thread T is not seized by threader hook 25. Thus, one can understand that the key to successful needle threading is the secure hold of needle thread T realized by introducing needle thread T between guide plate 34 of needle holder 27 and thread holding plate 35 to the extent that needle thread T is placed at the inner peripheral side of thread holding plate 35.

In the present exemplary embodiment, at the lower side surface of faceplate 5*a* of sewing machine head 5, passage resistance applier 38 is provided which is unitized with thread cut element 37. The user, after introducing needle thread T between guide plate 34 of thread holder 27 and thread holding plate 35, is to bring needle thread T rearwardly upward at the left side of sewing machine head 5. Then, as shown in solid line in FIG. 6A, needle thread T is moved in the direction indicated by arrow D from the rear side of passage resistance applier 38 to introduce needle thread T into threading groove 42. Finally, needle thread T is placed in contact with blade 37*a* of thread cut element 37 as indicated by double-dot chain line in FIG. 6A to be cut. Needless to say, user safety is secured when cutting needle thread T.

As needle thread T introduced into threading groove 42 from the rear side is moved forward, it is passed between projection 39*a* and tension plate 40, and at this instance, a predetermined resistance or tension is applied on needle thread T. Needle thread T is thus, introduced far enough between guide plate 34 of thread holder 27 and thread holding plate 35 in the direction indicated by arrow C to the extent to be placed at the inner peripheral side of thread holding plate 35 to be held or clamped securely by thread holder 27.

According to the above described exemplary embodiment, passage resistance applier 38 is provided at threader unit 11 so as to be situated downstream relative to thread holder 27 in the threading path and upstream relative to thread cut element 37. As needle thread T is passed through passage resistance applier 38, a predetermined resistance is applied on needle thread T to cause needle thread T to be introduced far enough to reach the inner peripheral side of thread holding plate 35 of thread holder 27. Thus, needle thread T can be held securely by thread holder 27 in the preparatory steps in which the user engages needle thread T with the components provided along the threading path. The above advantage can be realized by merely providing a passage resistance applier 38 which eliminates the configuration to forcibly open/close thread holding plate 35 thereby obtaining a relatively simpler configuration.

Particularly in the present exemplary embodiment, passage resistance applier 38 is provided integrally and in the proximity of thread cut element 37, in other words, unitized with thread cut element 37. This allows compact installation of passage resistance applier 38 and thread cut element 37 on faceplate 5*a*. Not only does the above installation yield compactness but also facilitates user operability since application of resistance on needle thread T by passing needle thread T through passage resistance applier 38 and cutting of needle thread T can be performed in a consecutive sequence. Further, passage resistance applier 38, being configured by components such as cover 39*a* provided with projection 39*a*, tension plate 40, and coil spring 41, advantageously applies a predetermined resistance on needle thread T with relatively greater reliability.

Next, a description will be given on second and third exemplary embodiments with reference to FIGS. 8A, 8B and 9. Sewing machine body 1 inclusive of needle threader unit 11 described in the second and third exemplary embodiments is generally the same as the first exemplary embodiment but for few exceptions. The components that are identical to the first exemplary embodiment will be described with identical reference symbols and will not be shown nor described. Description will only be given hereinafter on portions that differ from the first exemplary embodiment.

The second exemplary embodiment differs from the first exemplary embodiment in the configuration of passage resistance applier, now represented by reference symbol 51. As was the case in the first exemplary embodiment, passage resistance applier 51 is provided at the lower side section of faceplate 5*a* situated on the left side surface of sewing machine head 5, in other words, to the rearwardly upward and leftward direction from thread holder 27 in the preparatory position. When needle thread T is passed through passage resistance applier 51, predetermined resistance is applied on needle thread T to cause needle thread T to be introduced to the inner peripheral side of needle holding plate 35.

Passage resistance applier 51 is configured by attaching a plastic cover 52 on the outer surface of faceplate 5*a* and providing leaf spring 53 on the inner surface side of cover 52. As shown in FIG. 9, the front end side of cover 51 is mounted on faceplate 5*a* by screw 43. Between the inner surface of cover 52 and the outer surface of faceplate 5*a* except the front end portion of cover 52, threading groove 54 is created for allowing needle thread T to pass through. Between cover 52 and faceplate 5*a*, thread cut element 37 is provided in the front end space that communicates with threading groove 54 such that cutting edge of blade 37*a* of thread cut element 37 is oriented rearward.

Figure 9:
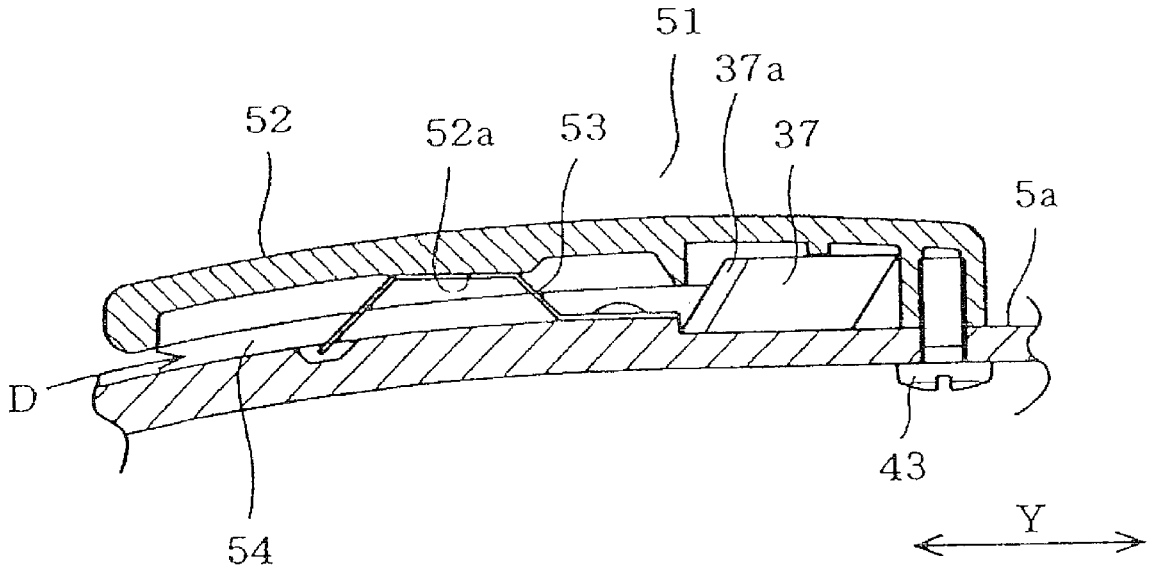
FIG. 9 is a transverse sectional view of the bottom of the passage resistance applier taken along line IX-IX of FIG. 8A.

As shown in FIG. 9, at the longitudinal (Y-directional) mid portion of cover 52, a protrusion 52*a* is formed that slightly protrudes toward faceplate 5*a*. Leaf spring 53 extends in the front and rear direction (Y-direction). The front end of leaf spring 53 is secured on faceplate 5*a* and its intermediary portion is bent in a trapezoid profile. Leaf spring 53 exerts consistent bias to elastically press itself against protrusion 52*a* by its own spring force. The rear end side leaf spring 53 slopes into a guide surface.

Figure 8A:
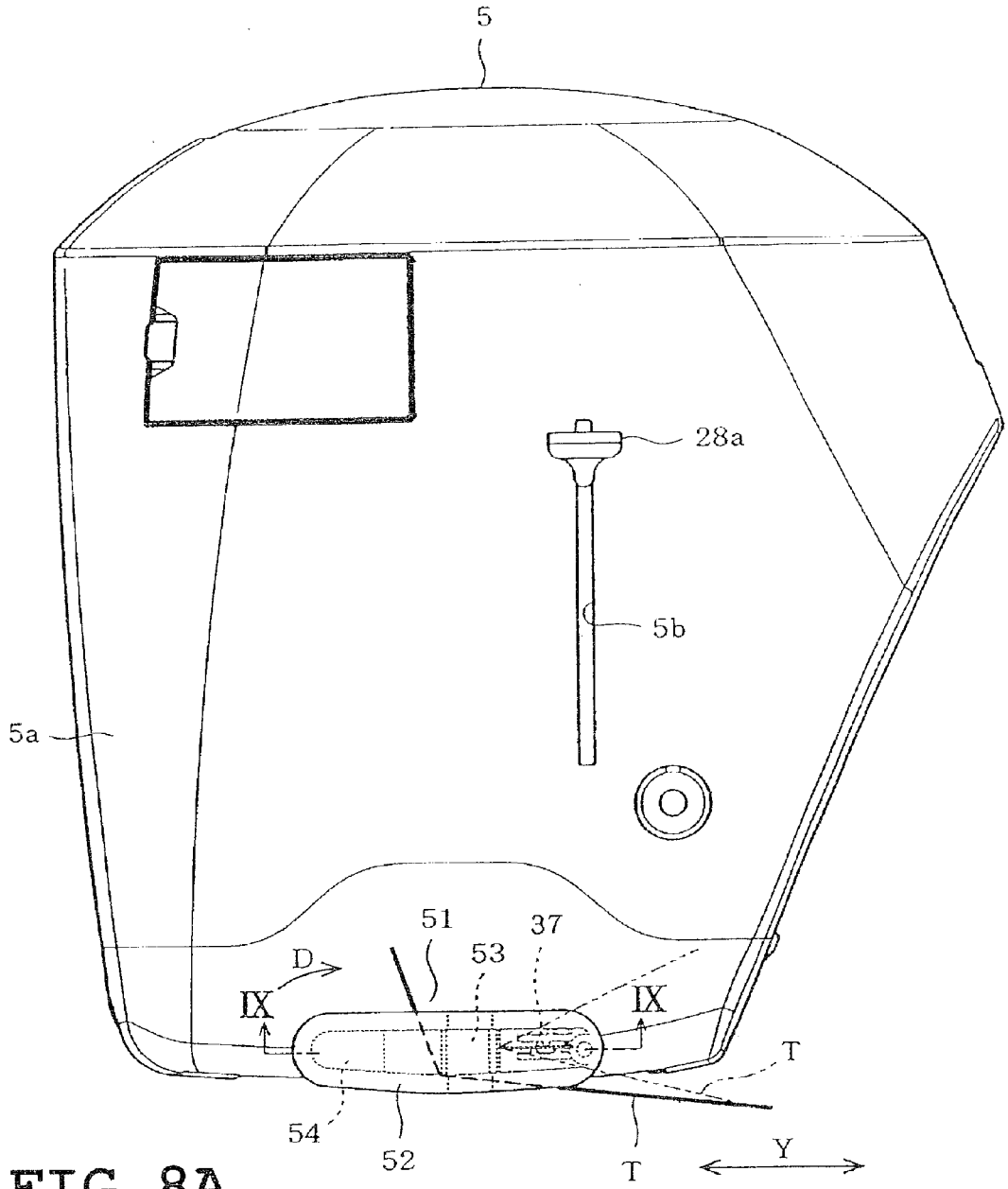
FIG. 8A is a left side view of the sewing machine head according to a second exemplary embodiment.
Figure 8B:
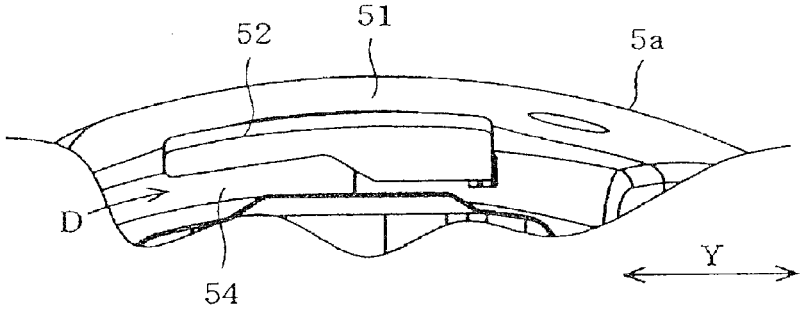
FIG. 8B is a bottom view of the passage resistance applier.

According to the above described configuration, the user prepares for the threading operation by engaging needle thread T with thread holder 27 and bringing the tip of needle thread T rearwardly above cover 52 of passage friction applier 51 as shown in FIG. 8A. Then, by moving needle thread T forward in the direction indicated by arrow D while introducing needle thread T into threading groove 54, needle thread T is passed between protrusion 52*a* and leaf spring 53 to apply a predetermined resistance or tension on needle thread T. The resistance applied on needle thread T urges needle thread T in the direction to be introduced between guide plate 34 of thread holder 27 and thread holding plate 35. After passing between protrusion 52*a* and leaf spring 53, needle thread T is cut by thread cut element 37.

According to the second exemplary embodiment, threader unit 11 has been provided that includes passage resistance applier 51 provided on faceplate 5*a* as was the case in the first exemplary embodiment. Thus, needle thread T can be held securely by thread holder 27 in the preparatory steps in which the user engages needle thread T with the components provided along the threading path. The above configuration can be realized advantageously in a relatively simpler configuration.

Passage resistance applier 51 of the second exemplary embodiment is also provided integrally and in the proximity of thread cut element 37, in other words, unitized with thread cut element 37. This allows compact installation of passage resistance applier 51 and thread cut element 37 on faceplate 5*a*. Not only does the above installation yield compactness but also facilitates user operability since application of resistance on needle thread T by passing needle thread T through passage resistance applier 51 and cutting of needle thread T can be performed in a consecutive sequence. Such configuration is also advantageous in reducing the number of parts of passage resistance applier 51.

Figure 10A:
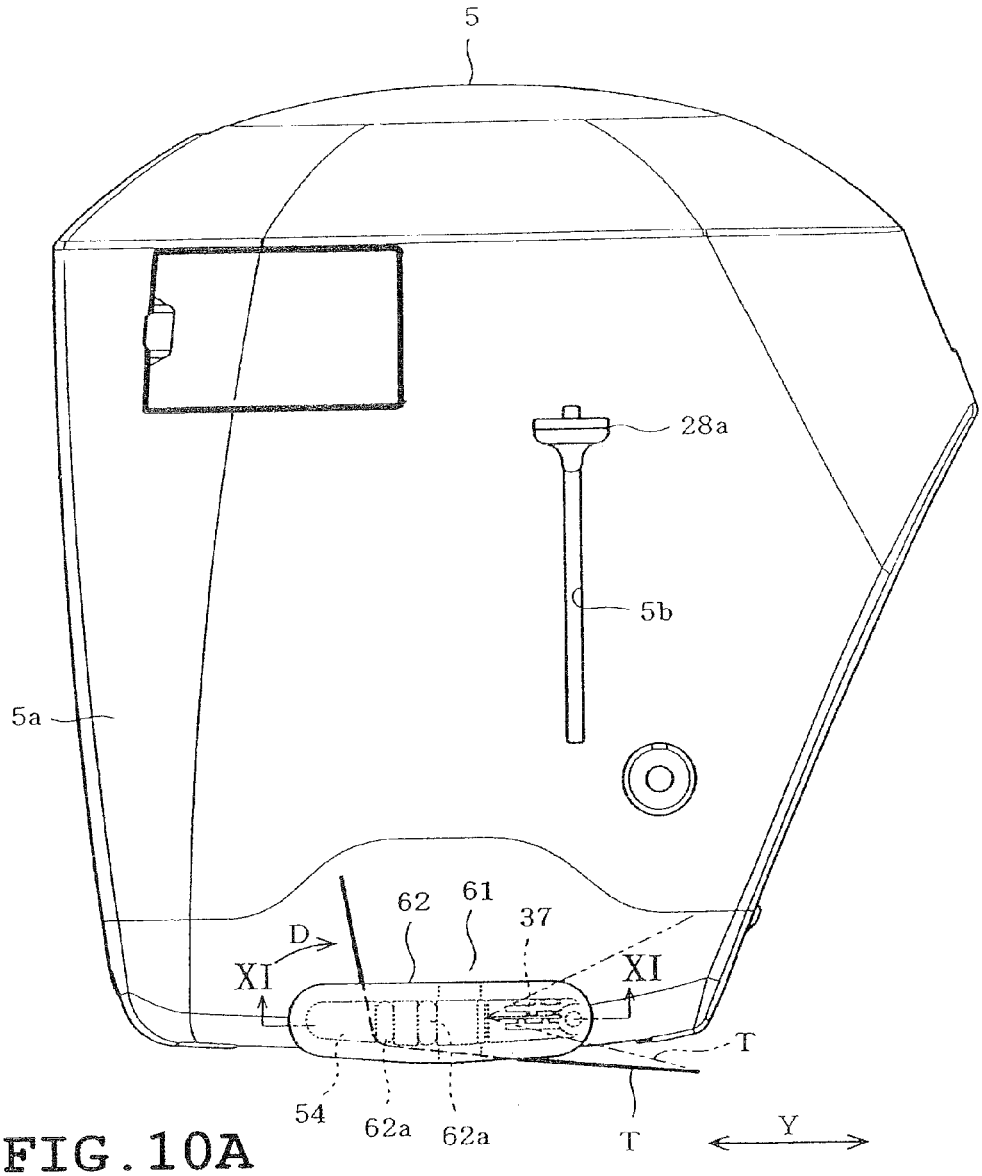
FIG. 10A is a left side view of the sewing machine head according to a third exemplary embodiment.
Figure 10B:
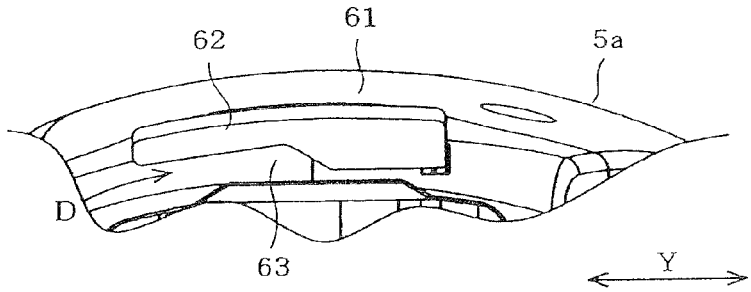
FIG. 10B is a bottom view of the passage resistance applier.
Figure 11:
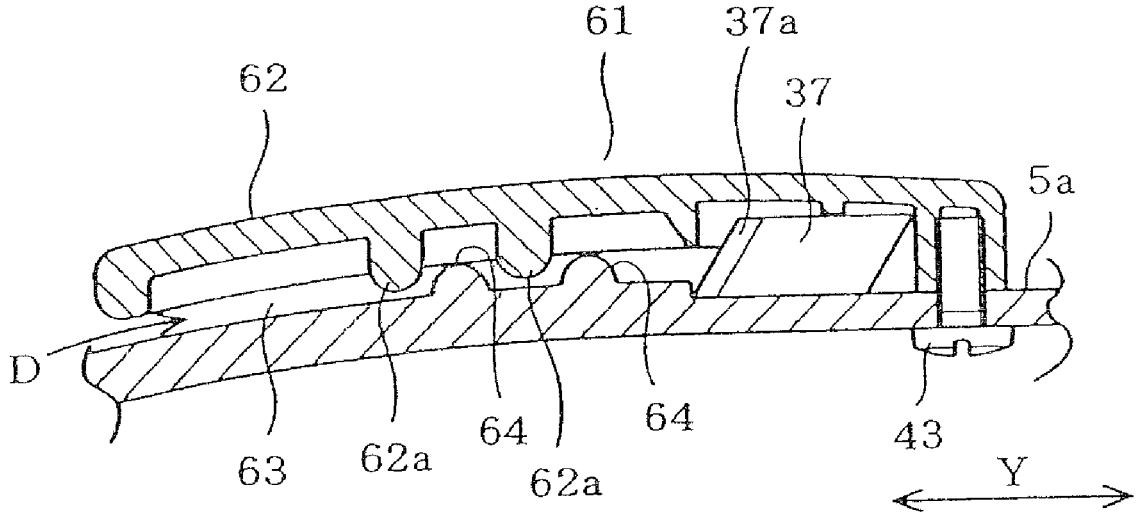
FIG. 11 is a transverse sectional view of the bottom of the passage resistance applier taken along line XI-XI of FIG. 10A.

FIGS. 10A, 10B and 11 illustrate a third exemplary embodiment of the present disclosure which also differs from the first exemplary embodiment in the configuration of passage resistance applier now represented as by reference symbol 61. Passage resistance applier 61 is configured by attaching a plastic cover 62 on the outer surface of faceplate 5*a* by securing the front end side of cover 62 on the outer surface of faceplate 5*a* by screw 43. Thus, threading groove 63 is generated between the inner surface of cover 62 and the outer surface of faceplate 5*a* except the front end portion of cover 62. Thread cut element 37 is provided in the front end space that communicates with threading groove 63 such that cutting edge of blade 37*a* of thread cut element 37 is oriented rearward.

At the substantial mid portion of the inner surface of cover 62, a couple of vertically extending bumps 62*a* are provided integrally that are spaced apart in the front and rear direction (left and right direction as viewed in FIG. 11). On the outer surface of faceplate 5*a*, on the other hand, a couple of protrusions 64 are provided alternately so as to be mated with the couple of bumps 62*a*. Threading groove 63 is thus, narrowed in width by couple of bumps 62*a* and couple of protrusions 64 to formulate a groove in a zigzag profile to allow needle thread T to pass through in a curve accordingly.

According to the above described configuration, the user prepares for the threading operation by engaging needle thread T with thread holder 27 and bringing the tip of needle thread T rearwardly above cover 62 of passage resistance applier 61 as shown in FIG. 10A. Then, by moving needle thread T forward in the direction indicated by arrow D while introducing needle thread T into threading groove 63. Thus, needle thread T is passed between couple of bumps 62*a* and couple of protrusions 64 while being curved by contact with bumps 62*a* and protrusions 64 to be given a predetermined level of resistance or tension. The resistance applied on needle thread T urges needle thread T in the direction to be introduced between guide plate 34 of thread holder 27 and thread holding plate 35.

According to the third exemplary embodiment, threader unit 11 has been provided that includes passage resistance applier 61 provided on faceplate 5*a*. Thus, needle thread T can be held securely by thread holder 27 in the preparatory steps in which the user engages needle thread T with the components provided along the threading path. The above configuration can be realized advantageously in a relatively simpler configuration.

Passage resistance applier 61 of the third exemplary embodiment is also provided integrally and in the proximity of thread cut element 37, in other words unitized with thread cut element 37. This allows compact installation of passage resistance applier 61 and thread cut element 37 on faceplate 5*a*. Not only does the above installation yield compactness but also facilitates user operability since application of resistance on needle thread T by passing needle thread T through passage resistance applier 61 and cutting of needle thread T can be performed in a consecutive sequence. Such configuration is also advantageous in reducing the number of parts of passage resistance applier 61.

Next, a description will be given on partial modifications of the above described exemplary embodiments.

The passage resistance applier disposed sideways to extend in the front and rear direction in each of the above described exemplary embodiments may be disposed vertically to extend up and down. In such case, the threading groove is provided to extend in the vertical direction and the element for applying resistance is provided at the vertical mid portion of the threading groove, whereas the thread cut element is provided at the lower end of the groove with the cutting edge of its bladed facing upward. Thus, the needle thread passed through the needle holder is introduced into the thread groove by moving the needle thread forwardly downward from the rear upward direction of the thread groove to be thereafter passed through the resistance applying section and cut by the thread cutting element. To summarize, passage resistance applier only requires that the needle thread passed through the thread holder be moved rearward and then turned back forward in a U-turn whereupon resistance is applied. Thus, passage resistance applier may come in many variations.

The couple of bumps 62*a* and the couple of protrusions 64 provided in the third exemplary embodiment may be modified as required as to their height and spacing to readily modify the passage resistance applied on needle thread T. Further, the tips of the couple of bumps 62*a* may be configured to nearly contact faceplate 5*a*. In such case, passage resistance may be applied on needle thread T passing through by the bendability of the plastic cover 62 itself.

The horizontal clamping surface of thread holding plate 35 of thread holder 27 in each of the above described exemplary embodiments may be slightly sloped to have higher elevation on at the left side of the clamping surface. Further, passage resistance applier and the thread cut element may be provided in separate locations that are spaced apart from the other. Yet further, specific configuration of threader unit 11 may be subjected to various modifications such as vertically moving the threader shafts electrically by drive sources such as a motor.

The foregoing description and drawings are merely illustrative of the principles of the present disclosure and are not to be construed in a limited sense. Various changes and modifications will become apparent to those of ordinary skill in the art. All such changes and modifications are seen to fall within the scope of the disclosure as defined by the appended claims.

What is claimed is:

1. A sewing machine that includes a sewing machine head, a needle thread supply and a needle bar configured to accept a sewing needle, the sewing machine comprising:

a threading path that is defined at the sewing machine head and that is sequentially engaged with needle thread drawn from the needle thread supply to guide the needle thread when threading the sewing needle;

a thread holder that is provided on the threading path and that includes a thread holding plate, thread holding plate being configured to receive an intermediate portion of the needle thread from an outer peripheral side to an inner peripheral side of the thread holder to clamp the needle thread;

a thread cutter that is provided on a faceplate that covers an outer surface of the sewing machine head, the thread cutter being configured to cut off a tip of the needle thread to obtain an appropriate thread length when threading the sewing needle;

a passage resistance applier that is provided downstream relative to the thread holder provided on the threading path and upstream relative to the thread cutter, the passage resistance applier being configured to apply a predetermined amount of resistance on the needle thread passing through the passage resistance applier to urge the intermediate portion of the needle thread to be positioned to the inner peripheral side of the thread holding plate of the thread holder so that the intermediate portion of the needle thread is clamped by the thread holder; and a cover provided on an outer surface of the faceplate, the thread cutter and the passage resistance applier being provided on an inner surface side of the cover.

2. The sewing machine according to claim 1, wherein the passage resistance applier is provided on the faceplate near the thread cutter.

3. The sewing machine according to claim 1, wherein the passage resistance applier includes a stationary element provided at the sewing machine head, a movable element capable of being placed in contact with and separated away from the stationary element and a biasing element that bias the movable element in a direction to be pressed in contact with the stationary element, and wherein the needle thread is passed between the stationary element and the movable element.

4. The sewing machine according to claim 2, wherein the passage resistance applier includes a stationary element provided at the sewing machine head, a movable element capable of being placed in contact with and separated away from the stationary element and a biasing element that bias the movable element in a direction to be pressed in contact with the stationary element, and wherein the needle thread is passed between the stationary element and the movable element.

5. The sewing machine according to claim 1, wherein the passage resistance applier includes a stationary element provided at the sewing machine head, an elastic element being pressed in elastic contact with the stationary element, and wherein the needle thread is passed between the stationary element and the elastic element.

6. The sewing machine according to claim 2, wherein the passage resistance applier includes a stationary element provided at the sewing machine head, an elastic element being pressed in elastic contact with the stationary element, and wherein the needle thread is passed between the stationary element and the elastic element.

7. The sewing machine according to claim 1, wherein the passage resistance applier includes a zigzag groove provided at the sewing machine head that allows the needle thread to curve through.

8. The sewing machine according to claim 2, wherein the passage resistance applier includes a zigzag groove provided at the sewing machine head that allows the needle thread to curve through.

* * * * *